US009289915B2

(12) United States Patent
Trudel

(10) Patent No.: US 9,289,915 B2
(45) Date of Patent: Mar. 22, 2016

(54) MANUFACTURING OF TONGUE AND GROOVE PROFILES ON HARDWOOD FLOORBOARDS

(75) Inventor: Pierre Trudel, Notre-Dame-du-Mont-Carmel (CA)

(73) Assignee: RENE ST-CYR (1996) INC., Notre-Dame-du-Mont-Carmel, Quebec (CA)

( * ) Notice: Subject to any disclaimer, the term of this patent is extended or adjusted under 35 U.S.C. 154(b) by 1189 days.

(21) Appl. No.: 13/146,260

(22) PCT Filed: Jan. 25, 2010

(86) PCT No.: PCT/CA2010/000117

§ 371 (c)(1),
(2), (4) Date: Jul. 26, 2011

(87) PCT Pub. No.: WO2010/085886

PCT Pub. Date: Aug. 5, 2010

(65) Prior Publication Data

US 2011/0284131 A1 Nov. 24, 2011

Related U.S. Application Data

(60) Provisional application No. 61/148,571, filed on Jan. 30, 2009.

(51) Int. Cl.

| | |
|---|---|
| ***B27F 1/06*** | (2006.01) |
| ***E04F 15/02*** | (2006.01) |
| ***E04F 15/04*** | (2006.01) |

(52) U.S. Cl.

CPC ..... *B27F 1/06* (2013.01); *E04F 15/02033* (2013.01); *E04F 15/04* (2013.01); *E04F 2201/0107* (2013.01)

(58) Field of Classification Search

CPC ..... Y10T 29/49771; B27F 1/02; B27F 1/06; B27F 1/08; B27F 1/10; B27F 1/12; B27F 1/14; B27F 1/16; B27F 5/00; B27F 5/02

USPC ..... 144/82, 86, 367, 368, 371, 372; 700/159; 702/158, 166, 150; 83/522.17–522.21

See application file for complete search history.

(56) References Cited

U.S. PATENT DOCUMENTS

| | | | | |
|---|---|---|---|---|
| 5,052,452 | A * | 10/1991 | Goenner | 144/4.9 |
| 6,189,196 | B1 * | 2/2001 | Weathers | 29/450 |
| 7,219,706 | B2 * | 5/2007 | Stager | 144/218 |

FOREIGN PATENT DOCUMENTS

| | | |
|---|---|---|
| DE | 4105207 A1 | 8/1991 |
| WO | WO2006/103565 | 10/2006 |

OTHER PUBLICATIONS

Extended European Search Report for EP Application No. 10735461.5 dated Apr. 13, 2015.

*Primary Examiner* — Matthew G Katcoff

(74) *Attorney, Agent, or Firm* — Norton Rose Fulbright Canada Corp.

(57) ABSTRACT

The undersurface (22) of the floorboards (10) is used as a main reference for taking measurements in a tongue and groove floorboard quality control process. The process comprises measuring at least one distance (X, Y) between the undersurface (22) and a downwardly facing surface of at least one of a tongue and a groove profile of selected ones of the floorboards (10). Measurements can be taken from the undersurface (22) of the selected boards (10) on both sides thereof to vertically adjust the relative position of groove cutter head (18) and the tongue cutter head (16) of the molding machine (M) used to manufacture the boards (10). A depth gage (G) can be used to take the measurements.

5 Claims, 3 Drawing Sheets

MANUFACTURING OF TONGUE AND GROOVE PROFILES ON HARDWOOD FLOORBOARDS

CROSS REFERENCE TO RELATED APPLICATIONS

The present application is a National Phase Entry of PCT/CA2010/000117 filed on Jan. 25, 2010 and claiming priority on U.S. Provisional Application No. 61/148,571 filed on Jan. 30, 2009.

FIELD OF THE INVENTION

The application relates generally to the manufacturing of tongue and groove profiles on wood floorboards and, more particularly, to a process for controlling the evenness of tongue and groove joints between adjacent floorboards.

BACKGROUND ART

The interlocking tongue and groove profiles along opposed longitudinal sides of hardwood floor boards, such as planks and strips, are typically made by milling. The boards are advanced on a table of a moulding machine (also known as a planning and grooving machine) between a pair of rotary cutters carrying cutting inserts or knives having cutting profiles corresponding to the profiles to be cut along the opposed sides of the boards. The relative height of the groove and tongue cutters must be precisely adjusted to ensure evenness of the boards when assembled together. Also, the position of the successive boards relative to the cutting tools must not vary from one board to another in order to provide for a smooth tongue and groove fit between the boards and ensure proper mating of the eased edges (also known as the micro-bevelled edges) of adjacent boards. If the vertical position of the boards relative to the groove and tongue cutters vary from one board to the next or if the relative vertical position of the groove and tongue cutters is not well adjusted, there will likely be a vertical offset V between the micro-bevelled edges of adjacent mating boards once assembled together, as shown in FIG. 4*b*. This can also result in unevenness of the floor boards once laid down on the sub-floor.

In order to prevent the delivery of such "defective" floor boards, many floorboard manufacturers have established a quality control process at the exit of the moulding machine. Such a quality control process typically consists of manually measuring with a vernier the thickness of the top or bottom lip of the groove profile of the boards combined with a visual inspection of the evenness of the joint between two assembled sample boards. The visual inspection can be carried out by placing a level or the like on one face of two assembled boards and verifying if there is any visually perceivable gap between the assembled boards and the level. If the measured thickness is substantially the same from one board to another and the results of the visual inspection are satisfactory, it is assumed that the joining of the boards will provide even tongue and groove joints. If the thickness varies or the gap between the level and the assembled boards is considered outside of the acceptable manufacturing tolerances, then the defective floorboard production is rejected or, whenever possible, reprocessed to ensure proper mating of the different board batches.

Such a quality control process has several drawbacks. First, the measurements obtained with a vernier may vary depending on the person taking the measurements. Also the visual inspection is subjective and the appreciation thereof may vary from one person to another. The results of the quality control process are, thus, greatly dependent on the skills of the operators and as such not always reliable.

Furthermore, even if the measurements are taken correctly, the thickness of the top or bottom lip of the groove profile may not be sufficient to guarantee perfect matching of the tongue and groove profiles or of the micro-bevelled edges of the boards.

There is thus a need to improve consistency in the production of tongue and groove floorboards.

SUMMARY

In view of the foregoing, it would be desirable to provide a new process by which the evenness of the tongue and groove joints between adjacent floorboards could be reliably and readily controlled.

According to a general aspect of the invention, it has been found that the precision of the quality control measurement process could be improved by using the undersurface of the floorboards as a reference surface and by measuring a depth on the groove profile and/or on the tongue profile of the boards relative to the undersurface of the boards rather than a thickness of the top or bottom lip of the groove profile. Such a depth can be measured by using a conventional depth gage, a laser or other electronic distance-measuring device. The selected measuring device or tool could, for instance, be used to measure the distance between the undersurface of a floorboard and the underside of the tongue thereof. The manufacturing process could also be modified to integrate a recess or groove/undercut in the undersurface of the bottom lip of the groove profile of the boards and the depth of the undercut could be measured to evaluate the positioning of the groove profile relative to the undersurface of the floorboard.

According to a further general aspect, the depth of the undercut in the bottom lip of the groove profile can be measured with a spring-loaded plunger gage. The base of the gage is abutted against the undersurface of the board with the tip of the spring-loaded plunger abutting against the bottom of the groove or undercut. Such a measurement procedure with a depth gage has proven to be accurate and less sensitive to the skills of the person taking the measurement. The modification of the groove profile of the boards (and thus the modification of the cutting profile of the knives used to cut the groove in the boards) to incorporate the longitudinal undercut in the undersurface of the bottom lip of the groove profile allows the integration of a depth reading procedure relative to the undersurface of the board on the groove profile side thereof as part of a quality control process of the floorboard tongue and groove joints.

According to a further aspect of the present invention, a measurement can be taken not only on one side of the boards but on both sides thereof that is on the groove profile side and on the tongue profile side. The two measurements are taken from a common plane of reference, namely the undersurface of the board. These measurements allow to precisely adjusting the relative positioning of the groove and tongue cutter heads of the moulding machine in order to avoid any unacceptable mismatch or vertical offsets between the tongue and groove profiles of the floorboards when assembled together on a sub-floor structure. The measurement on the groove profile side of the board can be obtained by measuring a depth Y of the undercut defined in the bottom lip of the groove profile (i.e. the distance between the bottom surface of the undercut and the undersurface of the board). The measurement on the tongue profile side of the board can be obtained by using again the undersurface of the board as a reference plane to measure the distance X between the underside of the tongue and the undersurface of the board. The same depth measuring tool can be used to measure both the depth Y of the undercut on the groove profile side and the distance X between the undersurface of the board and the underside of the tongue on the tongue profile side of the board. If the groove and tongue cutters of the moulding machine are well adjusted, the difference between the X value and the Y value shall be equal (±the manufacturing tolerances) to the thickness Z of the bottom lip of the groove profile of the board, which is a constant fixed by the cutting profile of the groove cutter. The relative positioning of the groove and tongue cutters is adequate, when the equation: $X-Y=Z$ is satisfied. Any deviations from constant Z provide a direct indication of the distance by which the groove cutter head and the tongue cutter head must be displaced relative to one another to avoid a vertical offset between the tongue and groove profiles of assembled floorboards.

According to a further general aspect of the present invention, the tongue and groove floorboard manufacturing process is characterized by taking measurements on both first and second longitudinal sides of a floorboard relative to a common plane of reference corresponding to an undersurface of the floorboard. A first measurement on the first longitudinal side of the floorboard is indicative of the position of the groove relative to the undersurface of the floorboard. A second measurement on the second longitudinal side of the floorboard is indicative of the position of the tongue relative to the undersurface of the floorboard. The first and second measurements are then used to adjust the position of the groove and tongue profile cutters relative to one another on the moulding machine.

According to a further general aspect of the invention, there is provided a tongue and groove floor board quality control process for the production of hardwood floorboards having interconnecting tongue and groove profiles defined along opposed longitudinal sides thereof, the process comprising: using the undersurface of the floorboards as a reference plane for taking some measurements, measuring a distance between a downwardly facing surface of at least one of said tongue and groove profiles and the undersurface of selected ones of the floorboards, and determining if the measured distance is contained within acceptable manufacturing tolerances.

According to a still further general aspect, there is provided a tongue and groove floorboard manufacturing process comprising milling interlocking tongue and groove profiles along opposed sides of incoming floorboards, the groove profile comprising a groove bounded by top and bottom lips, the bottom lip having an undercut defined therein; measuring a distance Y between the bottom of said undercut and an undersurface of selected ones of said floorboard, and determining if the measured distances fall within an acceptable range of deviations from a predetermined value.

The term "floorboard" should not be strictly construed to the preliminary meaning of the word and is intended to broadly refer to any floor planks, floor strips and the like used in the fabrication of hardwood and solid wood flooring.

The floorboard thickness is herein used to refer to the distance between the top surface and the undersurface of the boards.

BRIEF DESCRIPTION OF THE DRAWINGS

Reference will now be made to the accompanying drawings in which.

DETAILED DESCRIPTION

Figure 1:
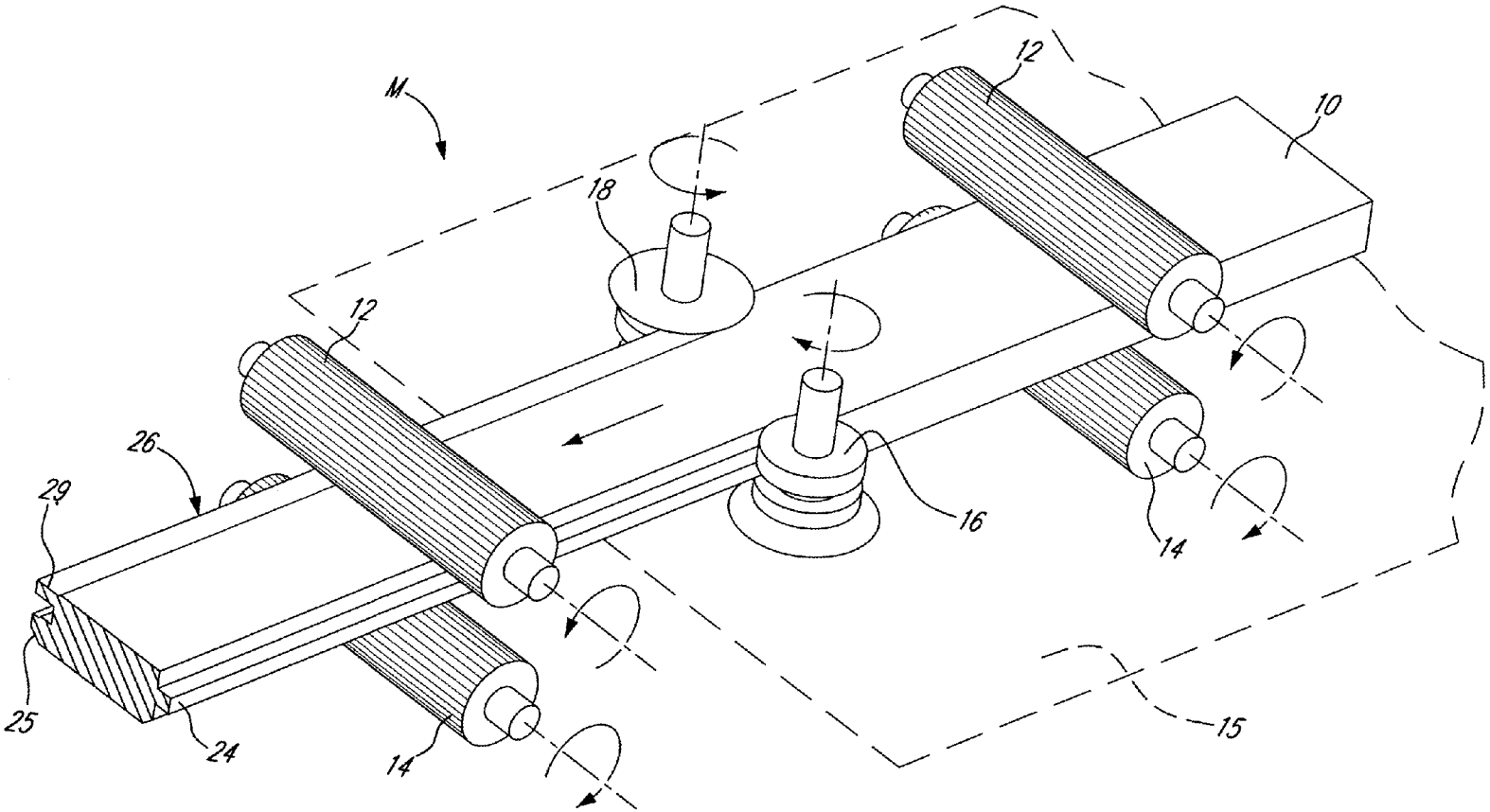
FIG. 1 is a schematic perspective view illustrating a solid wood floorboard in the process of being planed and profiled in a moulding machine according to a floorboard manufacturing process.

FIG. 1 illustrates a tongue and groove floorboard 10 in the process of being machined in a moulding machine M. Such machines typically include two or three pairs of top and bottom planer cylinders 12, 14 and a pair of axially staggered rotary cutter heads 16 and 18 disposed for receiving therebetween the boards to be planed and profiled. The boards are advanced on a steel table 15 between the cylinders 12, 14 and the profile cutter heads 16 and 18. The top planer cylinders 12 planed the undersurface 20 (see FIG. 3) of the floorboards, whereas the bottom cylinders 14 planed what will constitute the top facing surface 22 (see FIG. 3) of the floorboards after final sanding and varnishing operations (not shown).

Figure 2:
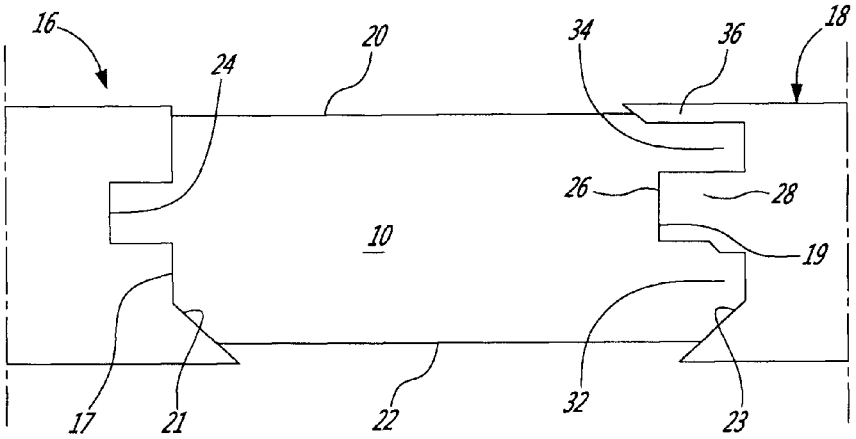
FIG. 2 is a schematic cross-sectional end view of a hardwood floorboard engaged between the moulding machine rotary cutters used to respectively cut the groove and tongue profiles along the opposed sides of the board while the same is being advanced through the machine shown in FIG. 1.

Referring to FIG. 2, the rotary cutter head 16 carries a number of circumferentially distributed knives or cutting inserts having a cutting profile 17 configured for machining a tongue profile 24 along one longitudinal side of the board 10. Likewise, the rotary cutter head 18 carries a number of circumferentially distributed knives having a cutting profile 19 configured for machining a corresponding groove profile 26 in the opposed longitudinal side of the board 10. The tongue and grooves profiles 24 and 26 are configured to provide for tongue and groove interlocking engagement of adjacent floorboards 10. In the illustrated example, both cutting profiles 17 and 19 include a slanted cutting edge portion 21, 23 for forming eased edges or micro-bevelled edges 25 (FIG. 3) at the top sides of the board 10. The groove cutting profile 19 provided by the rotary cutter head 18 (i.e. the groove cutter head) comprises a central outwardly projecting cutting portion 28 adapted to cut a groove 30 (FIG. 3) in the side of the board with a top lip 32 and a bottom lip 34. In addition to the central outwardly projecting cutting portion 28, the cutting profile 19 is provided at a top end thereof with an outwardly projecting cutting portion 36 for machining a groove or undercut 29 (FIG. 3) in the undersurface of the groove bottom lip 34. The groove bottom lip 34 is thus not only machined on a top side thereof but also on its bottom side. This provides for a constant thickness Z of the groove bottom lip 34 from one floorboard to another and that irrespective of possible height variations in the positioning of the boards relative to the groove cutter head 18. However, there is still a need to ensure that the groove profiles of the boards all start at the same height from a common reference surface in order to ensure smooth tongue and groove fit and prevent vertical offsets between the eased edges of the boards when laid down side by side in interlocking engagement on a sub-floor structure.

Figure 3:
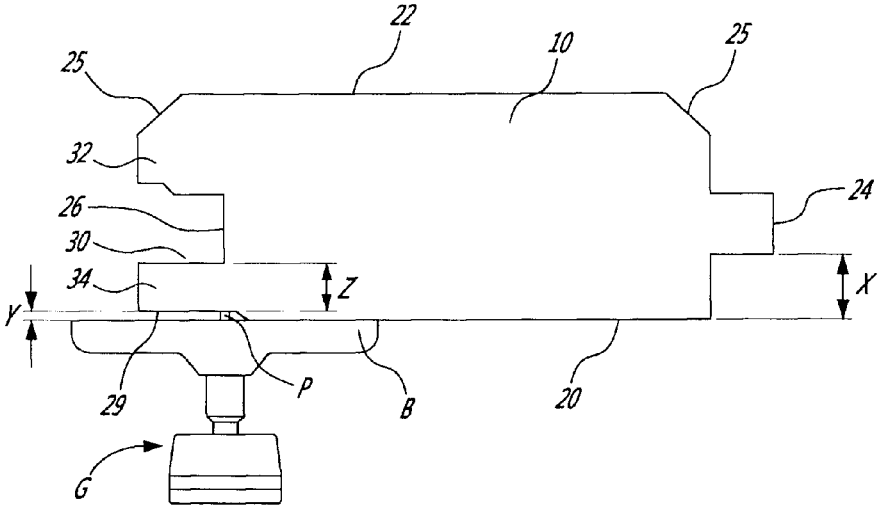
FIG. 3 illustrates a quality control inspection step of the floorboard manufacturing process, the inspection step comprising measuring with a spring-loaded plunger dial gage the depth of an undercut defined in the bottom lip of the groove profile cut in one side of the board by the rotary cutter shown on the left hand side of FIG. 2.

This can be verified and controlled by referencing the profiled underside of the bottom lip 34 to the planed undersurface 20 of the boards 10. As shown in FIG. 3, this can be conveniently achieved by measuring the depth Y of the undercut 29 with a conventional spring-loaded plunger dial depth gage G at the exit of the boards from the moulding machine. The base B of the gage G is abutted against the undersurface 20 with the tip of the spring-loaded plunger P resting against the bottom of the undercut 29. In the illustrated embodiment, a dial allows the operator to easily read the measured depth D of the undercut 29. It is understood that other suitable depth gage could be used as well to measure the depth of the undercut 29 (i.e. the distance between the reference surface, namely the board undersurface 20 and the underside of the bottom lip 34). This measuring procedure has proven to be more precise and less sensible to human intervention. According to a further aspect, the measuring of the distance between the reference surface, (i.e. the undersurface 20) and the cut underside of the bottom lip 34 of the groove profile 26 could be automated and accomplished through the use of any suitable sensors, laser measuring devices or the like.

Figure 4A:
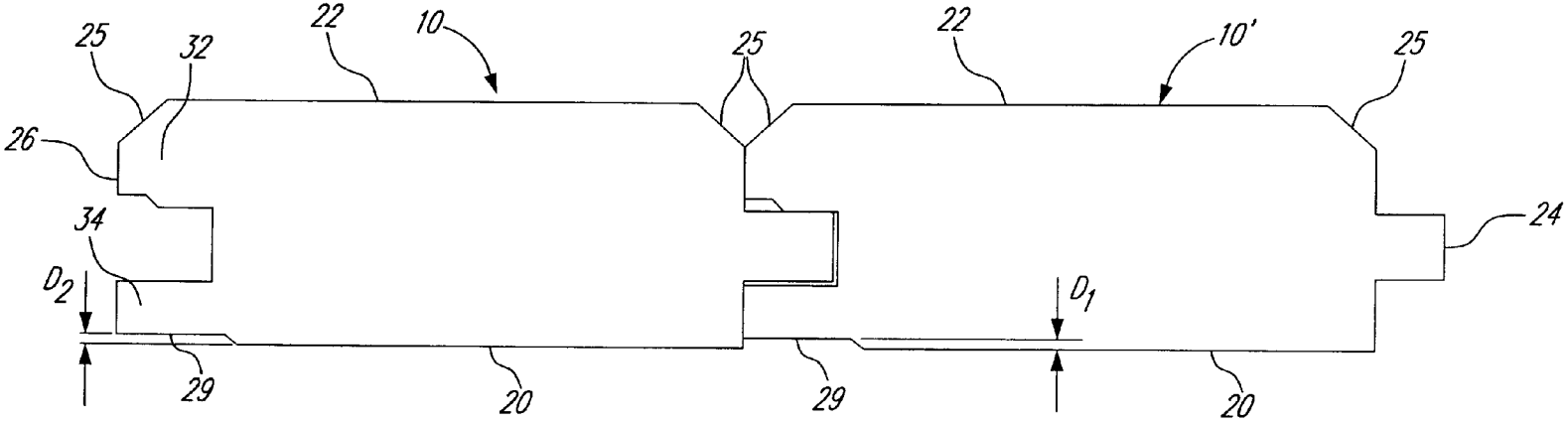
FIGS. 4*a* and 4*b* respectively illustrate even and uneven tongue and groove joints, the defective tongue and groove joint shown in FIG. 4*b* illustrating a vertical offset between the micro-bevelled edges of two adjacent floorboards as one potential consequences of an undetected groove and tongue profiling error.

As shown in FIG. 4*a*, if the measured depth D1, D2 of boards 10 and 10' respective undercuts 29 are substantially equal (i.e. contained within the established manufacturing tolerances), the top and bottom lips 32 and 34 will fit smoothly over the tongue 24 of board 10 with a perfect match of the micro-bevelled edges 25, thereby providing for levelled and precise micro V joint between the boards with no vertical offset between the tongue and groove profiles of the boards when the same are laid down on an underlying sub-floor. If one board is thicker than the other, the top surface of thicker board can be readily sanded to remove the excessive thickness of material therefrom without altering the apex of the V joint and the overall interlocking tongue and groove profile of the boards 10 and 10'.

Figure 4B:
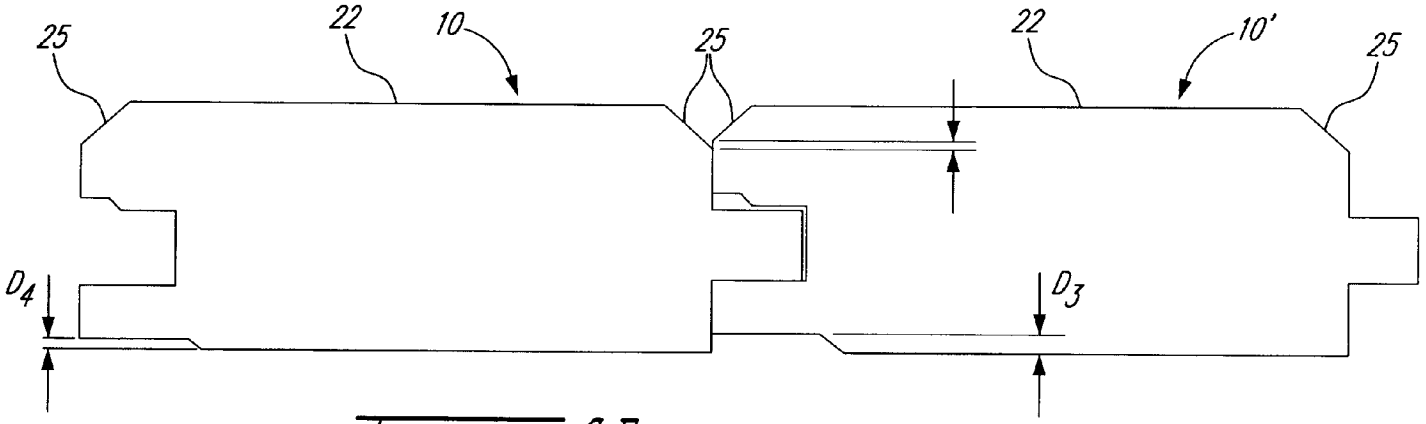

On the contrary if the measured undercut depths are different from one another (i.e. outside of the acceptable manufacturing tolerances) as illustrated in FIG. 4*b*, where the depth D3 is greater than the depth D4, then there will be a corresponding vertical offset "V" between the micro-bevelled edges and that even if the boards have the same overall thickness. If the difference between D3 and D4 is too important, it might even be difficult or even impossible to engage the tongue of the first board into the corresponding groove of the adjacent board when the same are laid down on the underlying sub-floor structure. The difference between D3 and D4 provides an indication that the position of the tongue and groove cutter heads 16 and 18 must be adjusted.

By using the depth of the undercut as the reference measurement in production instead of the thickness of the top lip of the groove profile, any variation of thickness between the floorboards can be corrected by sanding the top surface of the boards without altering the vertical match of tongue and groove profiles of the boards. By so measuring the floorboards during the production, it is possible to ensure consistency between the various production batches, thereby allowing floorboards of different batches to be assembled together in a substantially perfect co-planarity.

The relative vertical position of the tongue cutter head 16 and of the groove cutter head 18 must be well adjusted before the production of each batch of floorboards to ensure proper matching of the tongue and groove profiles of adjacent boards. This adjustment can be initially made and periodically verified by taking measurements on both the groove and tongue sides of the floorboards at their exit from the moulding machine M. For each inspected board, the board undersurface is used as a common plane of reference for the measurements taken on the two sides of the board.

As explained herein above, the measurement on the groove profile side of a floorboard can be obtained by measuring a depth Y (FIG. 3) of the undercut 29 defined in the bottom lip 34 of the groove profile (i.e. the distance between the bottom surface of the undercut 29 and the undersurface 20 of the board). As shown in FIG. 3, the measurement on the tongue profile side of the board 10 can be obtained by using again the undersurface 20 of the board as a reference plane to measure the distance X between the underside of the tongue 24 and the undersurface 20 of the board 10. The same depth measuring tool can be used to measure both the depth Y of the undercut 29 on the groove profile side and the distance X between the undersurface 20 of the board 10 and the underside of the tongue 24 on the tongue profile side of the board. If the tongue and groove cutter heads 16 and 18 of the moulding machine M are well adjusted, the difference between the X value and the Y value shall be equal (±the manufacturing tolerances) to the thickness Z of the bottom lip 34 of the groove profile of the board 10, Z being a constant fixed by the cutting profile 19 of the groove cutter head 18. The relative positioning of the tongue and groove cutter heads 16 and 18 is adequate, when the equation: $X-Y=Z$ is satisfied. Any deviations from the constant Z provide a direct indication of the distance by which the groove cutter head 18 and the tongue cutter head 16 must be displaced relative to one another to avoid a vertical offset between the tongue and groove profiles of the floorboards. This provides a very precise and rigorous method for adjusting the tongue and groove profile cutter heads 16 and 18 as compared to the prior art visual inspection of the evenness of two assembled boards.

The above description is meant to be exemplary only, and one skilled in the art will recognize that changes may be made to the embodiments described without departing from the scope of the invention disclosed. For example, it is understood that the same measuring methods could be used with floorboards having no micro-bevelled edges. Still other modifications which fall within the scope of the present invention will be apparent to those skilled in the art, in light of a review of this disclosure, and such modifications are intended to fall within the equivalents accorded to the appended claims.

What is claimed is:

1. In a tongue and groove floorboard manufacturing process wherein tongue and groove profile cutter heads of a moulding machine are used to define a corresponding tongue and groove along opposed first and second longitudinal sides of successive incoming floorboards; the improvement comprising: taking measurements on both first and second longitudinal sides of a floorboard relative to a common plane of reference corresponding to an undersurface of the floorboard, a first measurement on the first longitudinal side of the floorboard being indicative of the position of the groove relative to the undersurface of the floorboard, a second measurement on the second longitudinal side of the floorboard being indicative of the position of the tongue relative to the undersurface of the floorboard, and using said first and second measurements to adjust the position of the groove and tongue profile cutter heads relative to one another on the moulding machine, wherein the groove along the first longitudinal side of the floorboard has a bottom lip having an undercut defined in an undersurface thereof, the undercut forming part of the groove profile defined by the groove profile cutter head, wherein the first measurement is obtained by measuring a depth Y of said undercut relative to said undersurface of the floorboard, wherein said bottom lip has a thickness Z which is a constant determined by the groove profile of the groove cutter head, and wherein the method further comprises adjusting the relative position of the groove and tongue profile cutter heads when the difference between the second measurement X and the first measurement Y is different from the thickness Z of the bottom lip by a value which is outside a range of predetermined manufacturing tolerances, the distance by which the groove profile cutter head and the tongue profile cutter head are displaced relative to one another corresponding to the difference between Z and the value of the difference between X and Y.

2. The process defined in claim 1, wherein said first and second measurements are obtained by measuring a depth on each said first and second longitudinal sides of the floorboard.

3. The process defined in claim 1, wherein the second measurement comprises measuring a distance X between an underside of the tongue and the undersurface of the floorboard.

4. The process defined in claim 1, wherein the step of taking measurements comprises using a depth gage for measuring a distance between the undersurface of the floorboard and the underside of the tongue of the floorboard.

5. The process defined in claim 1, wherein the measurements are taken on selected floorboards at their exit from the moulding machine.

* * * * *